US011798507B2

(12) United States Patent
Ding et al.

(10) Patent No.: US 11,798,507 B2
(45) Date of Patent: Oct. 24, 2023

(54) IMAGE PROCESSING METHOD, APPARATUS, ELECTRONIC DEVICE, AND COMPUTER-READABLE STORAGE MEDIUM

(71) Applicants: Haining ESWIN IC Design Co., Ltd., Jiaxing (CN); Beijing ESWIN Computing Technology Co., Ltd., Beijing (CN)

(72) Inventors: Huawen Ding, Jiaxing (CN); Bo Zhao, Jiaxing (CN)

( * ) Notice: Subject to any disclaimer, the term of this patent is extended or adjusted under 35 U.S.C. 154(b) by 0 days.

(21) Appl. No.: 18/147,403

(22) Filed: Dec. 28, 2022

(65) Prior Publication Data

US 2023/0230555 A1 Jul. 20, 2023

(30) Foreign Application Priority Data

Jan. 20, 2022 (CN) ..... 202210068082.8

(51) Int. Cl.
*G09G 3/36* (2006.01)

(52) U.S. Cl.
CPC ..... *G09G 3/36* (2013.01); *G09G 2320/0252* (2013.01); *G09G 2320/0261* (2013.01);
(Continued)

(58) Field of Classification Search
CPC ..... G09G 3/36; G09G 2320/0252; G09G 2320/0261; G09G 2320/103; G09G 2340/16; G09G 2360/16; G09G 2320/02
See application file for complete search history.

(56) References Cited

U.S. PATENT DOCUMENTS 11,138,953 B1 10/2021 Wu
2006/0233460 A1* 10/2006 Kondo ..... G06T 3/403 382/276
(Continued)

FOREIGN PATENT DOCUMENTS

EP 1923860 A2 5/2008
JP 2008281734 A 11/2008
(Continued)

OTHER PUBLICATIONS

Search Report dated Oct. 12, 2022 from the Office Action for Chinese Application No. 202210068082.8 dated Oct. 21, 2022, pp. 1-3.

*Primary Examiner* — Antonio Xavier
(74) *Attorney, Agent, or Firm* — Lerner David LLP

(57) ABSTRACT

Embodiments of the present disclosure provide an image processing method, an apparatus, an electronic device, and a computer-readable storage medium, relating to the technical field of displays. The method comprises steps of: acquiring a first image and a second image that are adjacent in time-domain; determining dynamic pixels of the second image relative to the first image; determining overdrive gain values of the dynamic pixels; and performing overdrive processing on the second image according to the overdrive gain values. In the embodiments of the present disclosure, for the dynamic pixels, overdrive processing is performed on the image according to the overdrive gain value. Thus, the overdrive effect for the dynamic region of the image is optimized, the technical effect of the overdrive is ensured, and the motion blur problem of the image is effectively improved.

9 Claims, 5 Drawing Sheets

(52) U.S. Cl.
CPC ... *G09G 2320/103* (2013.01); *G09G 2340/16* (2013.01); *G09G 2360/16* (2013.01)

(56) References Cited

U.S. PATENT DOCUMENTS

| | | | | |
|---|---|---|---|---|
| 2010/0302287 | A1 | 12/2010 | Katayama et al. | |
| 2011/0206282 | A1* | 8/2011 | Aisaka | G06T 11/60 382/195 |
| 2018/0005596 | A1 | 1/2018 | Zeng | |
| 2018/0308415 | A1 | 10/2018 | Hsu et al. | |
| 2020/0092591 | A1* | 3/2020 | Sabatier | H04N 13/332 |
| 2020/0410727 | A1* | 12/2020 | Yamakawa | G01N 23/044 |
| 2021/0136375 | A1* | 5/2021 | Lorcy | H04N 19/176 |
| 2021/0176492 | A1* | 6/2021 | Kim | H04N 19/159 |
| 2022/0237783 | A1* | 7/2022 | Wong | G01N 1/30 |

FOREIGN PATENT DOCUMENTS

| | | | |
|---|---|---|---|
| WO | 2017114233 | A1 | 7/2017 |
| WO | 2017201811 | A1 | 11/2017 |

* cited by examiner

| | | |
|---|---|---|
| $g_1$ | $g_2$ | $g_3$ |
| $g_4$ | $g_5$ | $g_6$ |
| $g_7$ | $g_8$ | $g_9$ |

IMAGE PROCESSING METHOD, APPARATUS, ELECTRONIC DEVICE, AND COMPUTER-READABLE STORAGE MEDIUM

CROSS TO REFERENCE TO RELATED APPLICATIONS

This application claims benefit of priority to Chinese Patent Application No. 2022100680828 filed on Jan. 20, 2022, the disclosures of which are incorporated herein by reference in their entireties.

TECHNICAL FIELD

The present disclosure relates to the technical field of displays, and in particular to an image processing method, an apparatus, an electronic device, and a computer-readable storage medium.

BACKGROUND

With the development of science and technology, the application of liquid crystal displays is increasingly broad. Overdrive (OD) is one of the key techniques to improve the response speed of liquid crystal displays. By calculating the differences in the pixel values of image sequences by a compression algorithm to adjust the overdrive voltage, the overdrive technique improves the response time of liquid crystal displays and thus effectively improves the motion blur problem of the display screen.

However, in the overdrive process, the error introduced by the compression algorithm and the pixel difference between the previous and subsequent frames caused by movement may be mixed together, resulting in the mismatch between the OD voltage and the current image. As a result, the overdrive effect is poor.

SUMMARY

According to an aspect of the embodiments of the present disclosure, an image processing method is provided, comprising:

acquiring a first image and a second image that are adjacent in time-domain;

determining dynamic pixels of the second image relative to the first image;

determining overdrive gain values of the dynamic pixels; and performing overdrive processing on the second image according to the overdrive gain values.

Optionally, the determining of the dynamic pixels of the second image relative to the first image comprises:

performing time-domain differential processing on the first image and the second image to obtain first dynamic pixels of the second image relative to the first image;

performing space-domain differential processing on the second image to obtain gradient information of the second image;

acquiring time-domain distances between the first image and the second image;

determining second dynamic pixels of the second image relative to the first image according to the time-domain distances and the gradient information; and acquiring overlapping pixels of the first dynamic pixels and the second dynamic pixels as the dynamic pixels.

Optionally, the acquiring of the time-domain distances between the first image and the second image comprises:

generating residual blocks based on gray differences between corresponding pixels in the first image and the second image; wherein the number of the residual blocks is the same as the number of pixels in the second image; and determining the time-domain distances between the first image and the second image according to the residual blocks.

Optionally, the determining of the time-domain distances between the first image and the second image according to the residual blocks comprises:

for each of the residual blocks, calculating a sum of all residual values included in the residual block, and determining the sum as the time-domain distance of a pixel corresponding to the residual block.

Optionally, the performing time-domain differential processing on the first image and the second image to obtain the first dynamic pixels of the second image relative to the first image comprises:

determining gray differences between corresponding pixels in the first image and the second image as movement data of the pixels; and determining pixels corresponding to the movement data as the first dynamic pixels, when the movement data is greater than a preset movement threshold.

Optionally, the determining of the overdrive gain values of the dynamic pixels comprises:

acquiring residual blocks corresponding to the respective dynamic pixels as target residual blocks;

dividing each of the target residual blocks in time-domain to obtain a sub-residual block set corresponding to each of the target residual blocks;

generating residual statistics for each of the target residual blocks by performing statistics on residual values of the sub-residual block set; and determining the overdrive gain value corresponding to the residual statistics.

Optionally, the generating of the residual statistics for each of the target residual blocks by performing statistics on the residual values of the sub-residual block set comprises any one of:

for the sub-residual block set corresponding to the target residual block, determining a maximum of residual values of sub-residual blocks included in the sub-residual block set as the residual statistics of the target residual block; or for the sub-residual block set corresponding to the target residual block, determining a mean value of the residual values of all of the sub-residual blocks as the residual statistics of the target residual block.

According to another aspect of the embodiments of the present disclosure, an image processing apparatus is provided, comprising:

an acquisition module, configured to acquire a first image and a second image that are adjacent in time-domain;

a first determination module, configured to determine dynamic pixels of the second image relative to the first image;

a second determination module, configured to determine overdrive gain values of the dynamic pixels; and a correction module, configured to perform overdrive processing on the second image according to the overdrive gain values.

Optionally, the first determination module is configured to:

perform time-domain differential processing on the first image and the second image to obtain first dynamic pixels of the second image relative to the first image;

perform space-domain differential processing on the second image to obtain gradient information of the second image;

acquire time-domain distances between the first image and the second image;

determine second dynamic pixels of the second image relative to the first image according to the time-domain distances and the gradient information; and acquire overlapping pixels of the first dynamic pixels and the second dynamic pixels as the dynamic pixels.

Optionally, the first determination module is further configured to:

generate residual blocks based on gray differences between corresponding pixels in the first image and the second image; wherein the number of the residual blocks is the same as the number of pixels in the second image; and determine the time-domain distances between the first image and the second image according to the residual blocks.

Optionally, the first determination module is further configured to:

for each of the residual blocks, calculate a sum of all residual values included in the residual block, and determine the sum as the time-domain distance of a pixel corresponding to the residual block.

Optionally, the first determination module is further configured to:

determine gray differences between corresponding pixels in the first image and the second image as movement data of the pixels; and determine pixels corresponding to the movement data as the first dynamic pixels, when the movement data is greater than a preset movement threshold.

Optionally, the second determination module is configured to:

acquire residual blocks corresponding to the respective dynamic pixels as target residual blocks;

divide each of the target residual blocks in time-domain to obtain a sub-residual block set corresponding to each of the target residual blocks;

generate residual statistics for each of the target residual blocks by performing statistics on residual values of the sub-residual block set; and determining the overdrive gain value corresponding to the residual statistics.

Optionally, the second determination module is further configured to:

for the sub-residual block set corresponding to the target residual block, determine a maximum of residual values of sub-residual blocks included in the sub-residual block set as the residual statistics of the target residual block; or for the sub-residual block set corresponding to the target residual block, determine a mean value of the residual values of all of the sub-residual blocks as the residual statistics of the target residual block.

According to another aspect of the embodiments of the present disclosure, an electronic device is provided, comprising a memory, a processor, and a computer program stored in the memory, wherein the processor executes the computer program to implement the method shown in the first aspect of the embodiments of the present disclosure.

According to another aspect of the embodiments of the present disclosure, a computer-readable storage medium is provided, the computer-readable storage medium has a computer program stored thereon that, when executed by a processor, implements the method shown in the first aspect of the embodiments of the present disclosure.

According to an aspect of the embodiments of the present disclosure, a computer program product is provided, the computer program product includes a computer program that, when executed by a processor, implements the method shown in the first aspect of the embodiments of the present disclosure.

BRIEF DESCRIPTION OF THE DRAWINGS

To describe the technical solutions of the embodiments of the present disclosure more clearly, the drawings to be used in the description of the embodiments of the present disclosure will be illustrated briefly.

DETAILED DESCRIPTION

Figure 1:
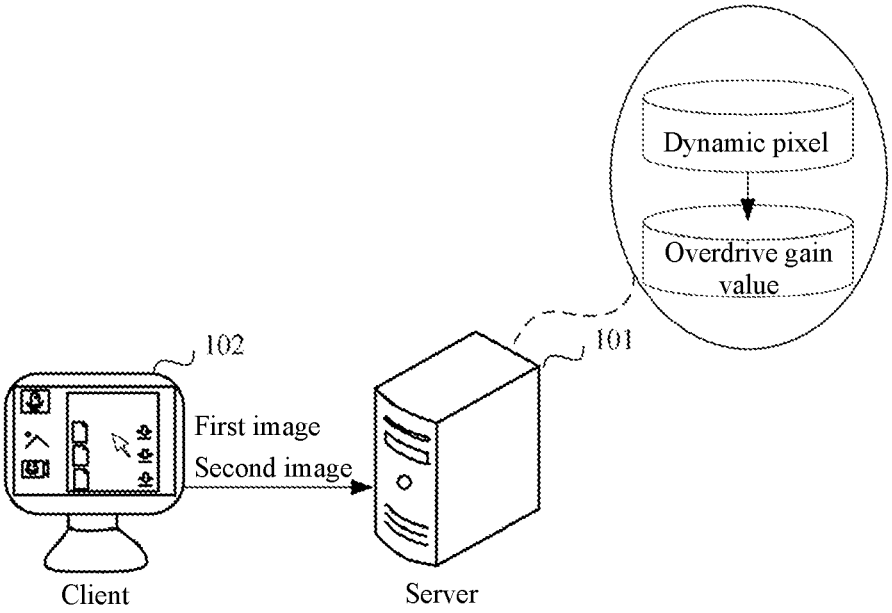
FIG. 1 is a schematic diagram of an application scenario of an image processing method according to an embodiment of the present disclosure.

Embodiments of the present disclosure will be described below with reference to the accompanying drawings in the present disclosure. It should be understood that the implementations to be described below with reference to the accompanying drawings are exemplary descriptions for explaining the technical solutions of the embodiments of the present disclosure, and do not limit the technical solutions of the embodiments of the present disclosure.

It may be understood by those ordinary skilled in the art that singular forms "a", "an" and "the" used herein may include plural forms as well, unless indicates otherwise. It should be further understood that the terms "comprising" and "including" used in the embodiments of the present disclosure mean that corresponding features may be implemented as the presented features, information, data, steps, operations, elements and/or components, but do not exclude implementations as other features, information, data, steps, operations, elements, components, and/or combinations thereof as supported in the art. It should be understood that, when an element is referred as being "connected to" or "coupled to" another element, this element may be directly connected or coupled to the other element, or this element and the other element may be connected through an intervening element. In addition, "connected to" or "coupled to" as used herein may include wireless connection or wireless coupling. The term "and/or" as used herein indicates at least one of the items defined by the term, e.g., "A and/or B" may be implemented as "A", or as "B", or as "A and B".

To make the purposes, technical solutions and advantages of the present disclosure more apparent, the implementations of the present disclosure will be further described below in detail with reference to the accompanying drawings.

Response time refers to reaction speed of liquid crystal displays to input signals, that is, reaction time of the liquid crystals from dark to bright or from bright to dark (the time for the brightness change 10%→90% or 90%→10%), usually in milliseconds (ms). From the human eye's perception of dynamic images, there is "visual persistence" in the human eyes. High-speed moving screens may form a short-term impression in the human brain. Cartoons, movies, and the latest games exactly use the principle of the visual persistence. A series of gradually changing images are displayed rapidly and successively in front of people's eyes to form moving images. The screen display speed acceptable to humans is generally 24 images per second, which is also the reason for the movie playback speed of 24 frames per second. If the display speed is lower than this, humans may obviously sense the pause of the screen and feel discomfort. Accordingly, the display time for each image needs to be less than 40 ms. In this way, for liquid crystal displays, the response time of 40 ms becomes a limit. Displays with the response time of higher than 40 ms may have obvious screen flickering which makes people feel dazzled. If it desires the display screen to be flicker-free, it is best to achieve a speed of 60 frames per second. Thus, it seems that the shorter the response time, the better.

In order to improve the response time of liquid crystal panels, the overdrive technique is usually used in the liquid crystal displays to improve the reaction speed of the liquid crystal molecules. Overdrive technology refers to performing overdrive processing according to the previous image and the current image, so as to obtain a corresponding overdrive voltage to drive the liquid crystal molecules, thereby improving the motion blur problem of the display screen.

In a scenario where the previous and subsequent frame image sequences are the same, the mismatch between the overdrive voltage and the image may be avoided by simply copying the source pixels of the subsequent frame image. In a scenario where the previous and subsequent image sequences are different, especially in a scenario where the background is the same while there are moving objects in the foreground, the error introduced by the compression algorithm and the pixel difference caused by moving images may be mixed together, and it is thus difficult to distinguish the static and dynamic regions simply through measures such as the pixel difference threshold. Generally, the pixel difference between the previous and subsequent frame images at positions with good overdrive effect may be greater than the compression error. The mismatch between the overdrive voltage and the image may be solved by wholly reducing the pixel difference. However, this will greatly decrease the overdrive effect.

The image processing method, apparatus, electronic device, and computer-readable storage medium according to the present disclosure are intended to solve at least one of the above technical problems.

The embodiment of the present disclosure provides an image processing method. The method may be implemented by a terminal or a server. By the terminal or server involved in the embodiment of the present disclosure, the dynamic pixels are determined by performing dynamic and static detection on pixels of two frame images that are adjacent in time-domain, thus the dynamic and static regions in the image are separated. Then, overdrive processing is performed on the image according to overdrive gain values corresponding to the dynamic pixels. Thus, in the embodiment of the present disclosure, the overdrive effect for the dynamic region of the image is optimized, and the technical effect of the overdrive is ensured.

The technical solutions of the embodiments of the present disclosure and the technical effects produced by the technical solutions of the present disclosure will be described below by describing exemplary implementations. It should be noted that the following implementations may refer to, learn from, or combine with each other, and the like terms, similar features, and similar implementation steps in different embodiments will not be described repeatedly.

As shown in FIG. 1, the image processing method according to the present disclosure may be applied to a scenario shown in FIG. 1. Specifically, a server 101 may acquire a first image and a second image that are adjacent in time-domain from a client 102 to determine dynamic pixels of the second image relative to the first image, and determine overdrive gain values for the dynamic pixels; and, the server then performs overdrive processing on the second image according to the overdrive gain values to ensure the overdrive effect.

In the scenario shown in FIG. 1, the image processing method described above may be performed in a server, and in other scenarios, it may be performed in a terminal.

It may be understood by those skilled in the art that the "terminal" as used herein may be a mobile phone, a tablet computer, a PDA (Personal Digital Assistant), a MID (Mobile Internet Device), etc. The "server" may be implemented as an independent server or a server cluster composed of multiple servers.

Figure 2:
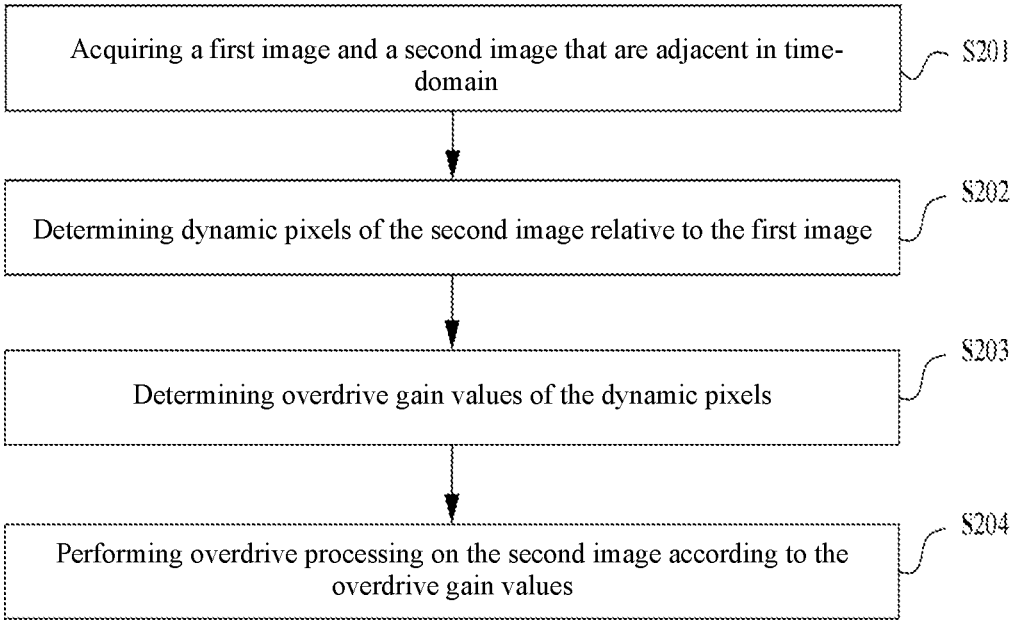
FIG. 2 is a schematic flowchart of an image processing method according to an embodiment of the present disclosure.

The embodiment of the present disclosure provides an image processing method, as shown in FIG. 2, comprising the following S201 to S204.

S201: Acquiring a first image and a second image that are adjacent in time-domain.

The first image and the second image may be two frame images that are adjacent in time-domain before being OD processed, and the timing of the first image may precede that of the second image. The numbers of pixels included in the first image and the second image are the same.

Specifically, the terminal or server used for image processing may acquire the first image and the second image from a preset database, and may also collect the first image and the second image in real time based on an image collect device, which is not limited in the embodiment.

S202: Determining dynamic pixels of the second image relative to the first image.

The first image and the second image may include dynamic and static regions. The static region may be an image region indicated by corresponding pixels with the same pixel information in the first image and the second image. The dynamic region may be an image region indicated by corresponding pixels with different pixel information in the first image and the second image.

Specifically, the terminal or server used for image processing may combine time-domain and space-domain information of the first image and the second image to perform dynamic and static detection on the first image and the second image, so as to determine dynamic pixels of the second image relative to the first image. The specific determination process of the dynamic pixels will be described in detail below.

S203: Determining overdrive gain values of the dynamic pixels.

Specifically, the terminal or server used for image processing may determine the overdrive gain values for the dynamic pixels by performing residual processing on the first image and the second image in time-domain.

The overdrive gain values described above may be used to correct OD voltage values of overdrive corresponding to the dynamic pixels.

S204: Performing overdrive processing on the second image according to the overdrive gain values.

Specifically, the terminal or server used for image processing may perform overdrive processing on the second image in combination with the overdrive gain values and the OD voltage values.

In the embodiment of the present disclosure, the terminal or server used for image processing may calculate difference between the pixel values of image sequences based on the first image and the second image, and then obtain the OD voltage value according to the difference. Then, based on a product of the OD voltage value and the overdrive gain value, overdrive processing is performed on the second image. For example, a final corrected OD voltage value may be obtained by adding the above product to the OD voltage value, and then the second image is overdrive processed based on the corrected OD voltage value. In this case, a range of the overdrive gain value may be any real number between 0 and 1.

In some implementations, the terminal or server used for image processing may correct the OD voltage value based on the overdrive gain value, and then perform overdrive processing on the second image based on the corrected OD voltage value.

In other implementations, the terminal or server for image processing may first perform overdrive processing on the second image based on the OD voltage value, and then correct the second image which is overdrive processed according to the overdrive gain value.

In the embodiments of the present disclosure, the dynamic pixels are determined by performing dynamic and static detection on pixels of two frame images that are adjacent in time-domain, thus the dynamic and static regions in the image are separated. Then, overdrive processing is performed on the second image according to the overdrive gain values corresponding to the dynamic pixels. In view of the shortcoming that the error introduced by the compression algorithm and the pixel difference caused by the dynamic pixel may be mixed together in the overdrive process, the OD voltage of the overdrive is corrected for the dynamic pixels according to the overdrive gain values in the present disclosure. Thus, the overdrive effect for the dynamic region of the image is optimized, the technical effect of the overdrive is ensured, and the motion blur problem of the image display is effectively improved.

Figure 3:
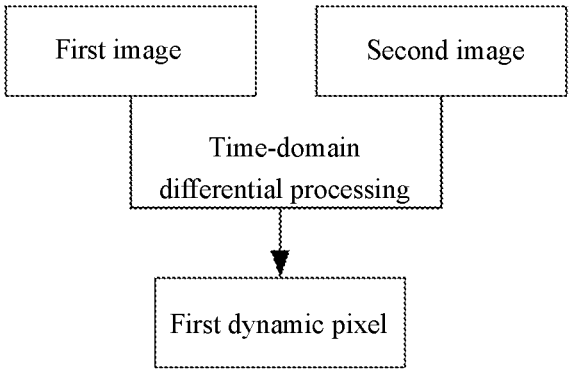
FIG. 3 is a schematic flowchart of determining first dynamic pixels in an image processing method according to an embodiment of the present disclosure.

A possible implementation is provided in the embodiment of the present disclosure. As shown in FIG. 3, the determining of the dynamic pixels of the second image relative to the first image in the S202 comprises the following (1)~(5).

(1) Performing time-domain differential processing on the first image and the second image to obtain first dynamic pixels of the second image relative to the first image.

Specifically, the terminal or server used for image processing may subtract pixel values of the first image and the second image pixel by pixel to obtain a difference of the pixel value of each of pixels, and then determine the first dynamic pixels based on absolute values of the above differences. The pixel value may include at least one of gray value, brightness, saturation, and hue.

In the embodiment of the present disclosure, the terminal or server used for image processing may perform calculations on pixels based on pixel values of multiple channels, or may also perform calculations on pixels based on pixel values of a single channel, which is not specifically limited in the embodiment.

Figure 4:
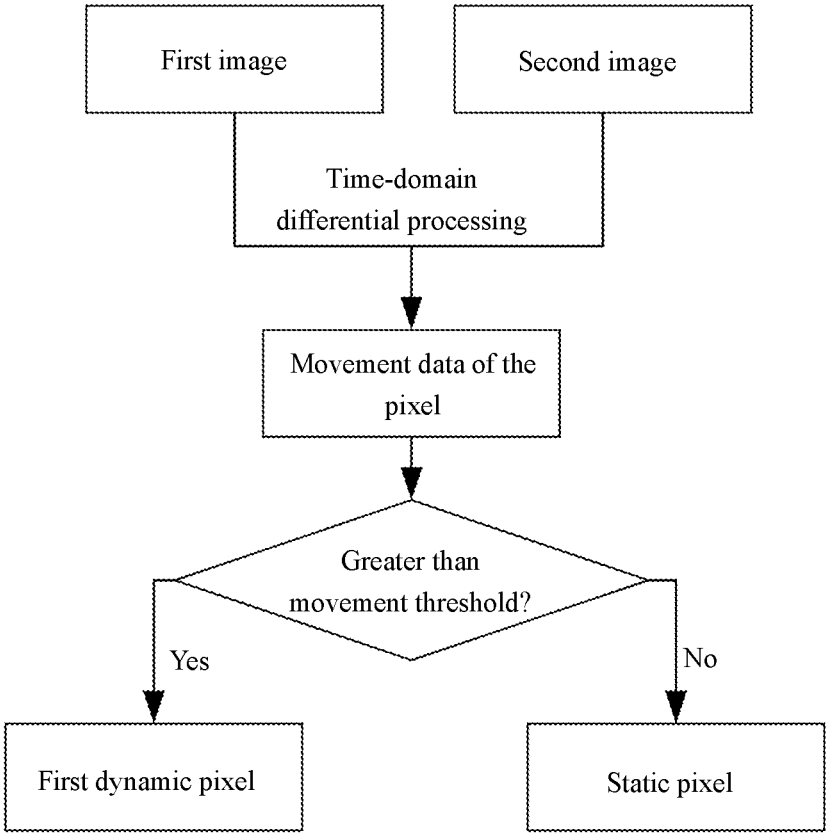
FIG. 4 is a schematic flowchart of dynamic pixel detection in an image processing method according to an embodiment of the present disclosure.

A possible implementation is provided in the embodiment of the present disclosure. Detailed description will be given by taking the pixel value being a gray value of a single channel as an example. As shown in FIG. 4, the performing of the time-domain differential processing on the first image and the second image to obtain the first dynamic pixels of the second image relative to the first image comprises the following a and b.

a: Determining gray differences between corresponding pixels in the first image and the second image as movement data of the pixels.

Specifically, the terminal or server used for image processing may calculate absolute value of the gray difference of each of the corresponding pixels in the first image and the second image, to obtain the movement data Move of each of the pixels. Dynamic and static detection in time-domain is performed on the first image and the second image according to the movement data Move.

b: determining pixels corresponding to the movement data as the first dynamic pixels, when the movement data is greater than a preset movement threshold.

In the embodiment of the present disclosure, the terminal or server used for image processing may preset the movement threshold MoveT, and determine the movement data Move of each of the pixels:

when Move is greater than MoveT, it is determined that the pixel is a first dynamic pixel; and when Move is not greater than MoveT, it is determined that the pixel is a static pixel.

(2) Performing space-domain differential processing on the second image to obtain gradient information of the second image.

Specifically, the terminal or server used for image processing may perform space-domain differential processing on the second image to obtain gradient values of each of the pixels in the second image in the horizontal and vertical directions, and obtain gradient information of the second image based on the gradient values.

In the embodiment of the present disclosure, the second image may be divided based on a unit size of n*m to obtain a blocks; then, the gradient values of each of the blocks in the horizontal and vertical directions are calculated based on a unit step $s_1$; and a maximum of the gradient values in the two directions is determined as the gradient information of the second image. The number of the pixels in the second image is also a. The n, m, and a are all integers, and $s_1$ is 1.

Figures 5, 6:
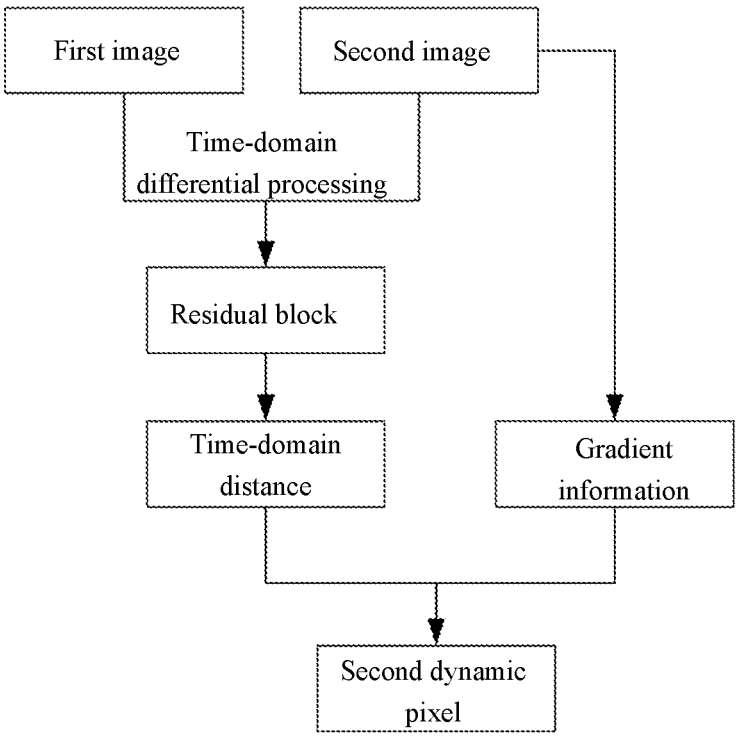
FIG. 5 is a schematic diagram of a block data structure in an image processing method according to an embodiment of the present disclosure.
FIG. 6 is a schematic flowchart of determining second dynamic pixels in an image processing method according to an embodiment of the present disclosure.

The following takes a size of a block being 3*3 as an example for specific description. The gray value data in the block is shown in FIG. 5. When the unit step $s_1$=1, the gradient value $G_1$ in the horizontal direction corresponding to the block is a sum of the absolute values of the differences between the data in the second column and the data in the first column and the absolute values of the differences between the data in the third column and the data in the second column, which may be obtained by the following formula (1):

$$G_1=|g_2-g_1|+g_5-g_4|+|g_8-g_7|+|g_3-g_2|+|g_6-g_5|+|g_9-g_8| \quad (1)$$

where, $g_1$ to $g_9$ are gray values of the pixels in the block.

The gradient value $G_2$ in the vertical direction corresponding to the block is a sum of the absolute values of the differences between the data in the second row and the data in the first row and the absolute values of the differences between the data in the third row and the data in the second row, which may be obtained by the following formula (2):

$$G_2=|g_4-g_1|+g_5-g_2|+|g_6-g_3|+|g_7-g_4|+|g_8-g_5|+|g_9-g_6| \quad (2)$$

Then, the maximum of $G_1$ and $G_2$ is determined as the gradient information G of the pixels corresponding to the block.

(3) Acquiring time-domain distances between the first image and the second image.

Specifically, the terminal or server for image processing may generate residual blocks according to time-domain difference information of the first image and the second image, and obtain the time-domain distances based on the residual blocks. In examples of the present disclosure, the time-domain difference information may include gray differences between corresponding pixels in the first image and the second image or RGB differences and the like. For the convenience of description, the following description takes the time-domain difference information including the gray differences as an example.

A possible implementation is provided in the embodiment of the present disclosure. The acquiring of the time-domain distances between the first image and the second image comprises the following a and b.

a: Generating residual blocks based on gray differences between corresponding pixels in the first image and the second image; wherein the number of the residual blocks is the same as the number of the pixels in the second image.

Specifically, the terminal or server used for image processing may calculate differences between gray values of the corresponding pixels in the first image and the second image to obtain the absolute values of the gray differences corresponding to respective pixels, and then generate residual blocks with the same number as the pixels in the second image or the first image based on the absolute value of each of the gray differences.

In the embodiment of the present disclosure, a residual blocks may be generated based on the unit size of n*m and the unit step $s_1$ according to the absolute value of the gray difference of each of the pixels, where the number of pixels in the first image is also a.

b: Determining the time-domain distances between the first image and the second image according to the residual blocks.

Specifically, the terminal or server used for image processing may perform time-domain transformation based on the residual blocks, and then determine the time-domain distances between the two images. The specific calculation process of the time-domain distances will be described in detail below.

A possible implementation is provided in the embodiment of the present disclosure. As shown in FIG. 6, the determining of the time-domain distances between the first image and the second image based on the residual blocks comprises: for each of the residual blocks, calculating a sum of all residual values included in the residual block, and determining the sum as the time-domain distance of the pixel corresponding to the residual block.

In the embodiment of the present disclosure, a residual blocks may be generated based on the unit size of n*m and the unit step $s_1$ according to the absolute value of the gray difference of each of the pixels, where the number of the pixels in the first image is also a. Then, the sum of the residual values (that is, the absolute values of the gray differences) in each of the residual blocks is calculated, and the sum of the absolute values of the gray differences in the residual block is determined as the time-domain distance M of the pixel corresponding to the residual block.

(4) Determining second dynamic pixels of the second image relative to the first image according to the time-domain distances and the gradient information.

Specifically, the terminal or server used for image processing may preset a compression error D introduced by image compression, and then comprehensively determine a dynamic or static state of each of the pixels according to the time-domain distance M, the gradient information G and the compression error D.

In the embodiment of the present disclosure, the determining may be made based on the following:

when $M \geq G+D$, it is determined that the pixel is a second dynamic pixel; and when $M \geq G+D$, it is determined that the pixel is a static pixel.

(5) Acquiring overlapping pixels of the first dynamic pixels and the second dynamic pixels as the dynamic pixels.

In the embodiment of the present disclosure, the final dynamic pixels to be processed may be determined based on the results of the two dynamic detections. In the process of the dynamic detections, the calculation information of the time-domain and the space-domain is integrated, so the finally determined dynamic pixels are more accurate. Meanwhile, in the process of the dynamic detections, the compression error introduced by image compression is also comprehensively considered, so the compression error and the movement data of the pixels are effectively separated, which provides foundation for the accuracy of the subsequently overdrive processing on the image.

A possible implementation is provided in the embodiment of the present disclosure. In the step S203, the determining of the overdrive gain values of the dynamic pixels comprises the following (1)~(4).

(1) Acquiring residual blocks corresponding to the respective dynamic pixels as target residual blocks.

In the embodiment of the present disclosure, the OD processing is use to improve the motion blur problem of the image, therefore, after completing the dynamic detection of the image, the terminal or server used for image processing only needs to simply copy data of the previous frame for the static region of the image, and in the present disclosure, the subsequently OD processing is only performed on the dynamic pixels, thus the OD effect may be effectively ensured.

(2) Dividing each of the target residual blocks in time-domain to obtain a sub-residual block set corresponding to each of the target residual blocks.

Specifically, the terminal or server used for image processing may divide each of the target residual blocks into k sub-residual blocks based on a unit size of h*j and a unit step $s_2$, and determine the above k sub-residual blocks as the sub-residual block set corresponding to the target residual block. The h, j, and k are all integers, and s2 may be 1.

(3) Generating residual statistics for each of the target residual blocks by performing statistics on residual values of the sub-residual block set.

Specifically, the terminal or server used for image processing may calculate an extreme or mean value of the residual values in the sub-residual block set, and then generate residual statistics of the corresponding target residual block based on the extreme or mean value.

A possible implementation is provided in the embodiment of the present disclosure. The generating residual statistics for each of the target residual blocks by performing statistics on residual values of the sub-residual block set comprise any one of the following a or b.

a: For the sub-residual block set corresponding to the target residual block, determining a maximum of residual values of the sub-residual blocks as the residual statistics of the target residual block.

In the embodiment of the present disclosure, the target residual block may be divided in time-domain to obtain k sub-residual blocks, and for each of the sub-residual blocks, a sum of the residual values included in the sub-residual block is determined as a residual value $b_d$, where d is an integer not less than 1 and not greater than k. Then, the maximum of the residual values $b_d$ is determined as the residual statistics of the corresponding target residual block.

In the embodiment of the present disclosure, since the maximum of the residual values is determined as the residual statistics, a large overdrive gain value may be obtained and the OD effect for the dynamic pixels may be maximized. In this case, the image processing method may be applied to high-speed moving image scenarios, for example, live football matches.

b: For the sub-residual block set corresponding to the target residual block, determining a mean value of the residual values of all sub-residual blocks as the residual statistics T of the target residual block.

In the embodiment of the present disclosure, the target residual block may be divided in time-domain to obtain k sub-residual blocks, and for each of the sub-residual blocks, the sum of the residual values included in the sub-residual block is determined as the residual value $b_d$, where d is an integer not less than 1 and not greater than k. Then, based on the following formula, the residual statistics T of the corresponding target residual block is calculated:

$$T = \frac{b_1 + b_2 + \ldots + b_k}{k} \tag{3}$$

In the embodiment of the present disclosure, since the mean value of the residual values is determined as the residual statistics, a balanced overdrive gain value may be obtained and the OD effect for the dynamic pixels may be balanced. In this case, the image processing method may be applied to richly textured and smooth image scenarios, for example, animal and plant documentaries.

(4) Determining the overdrive gain value corresponding to the residual statistics.

In some implementations, the terminal or server used for image processing may preset a functional relation between the residual statistics and the overdrive gain value, and then calculate the overdrive gain values based on the functional relation.

In other implementations, the terminal or server used for image processing may establish in advance a comparison table between the residual statistics and the overdrive gain values, and then search for the comparison table based on the residual statistics to obtain the corresponding overdrive gain values.

Figure 7:
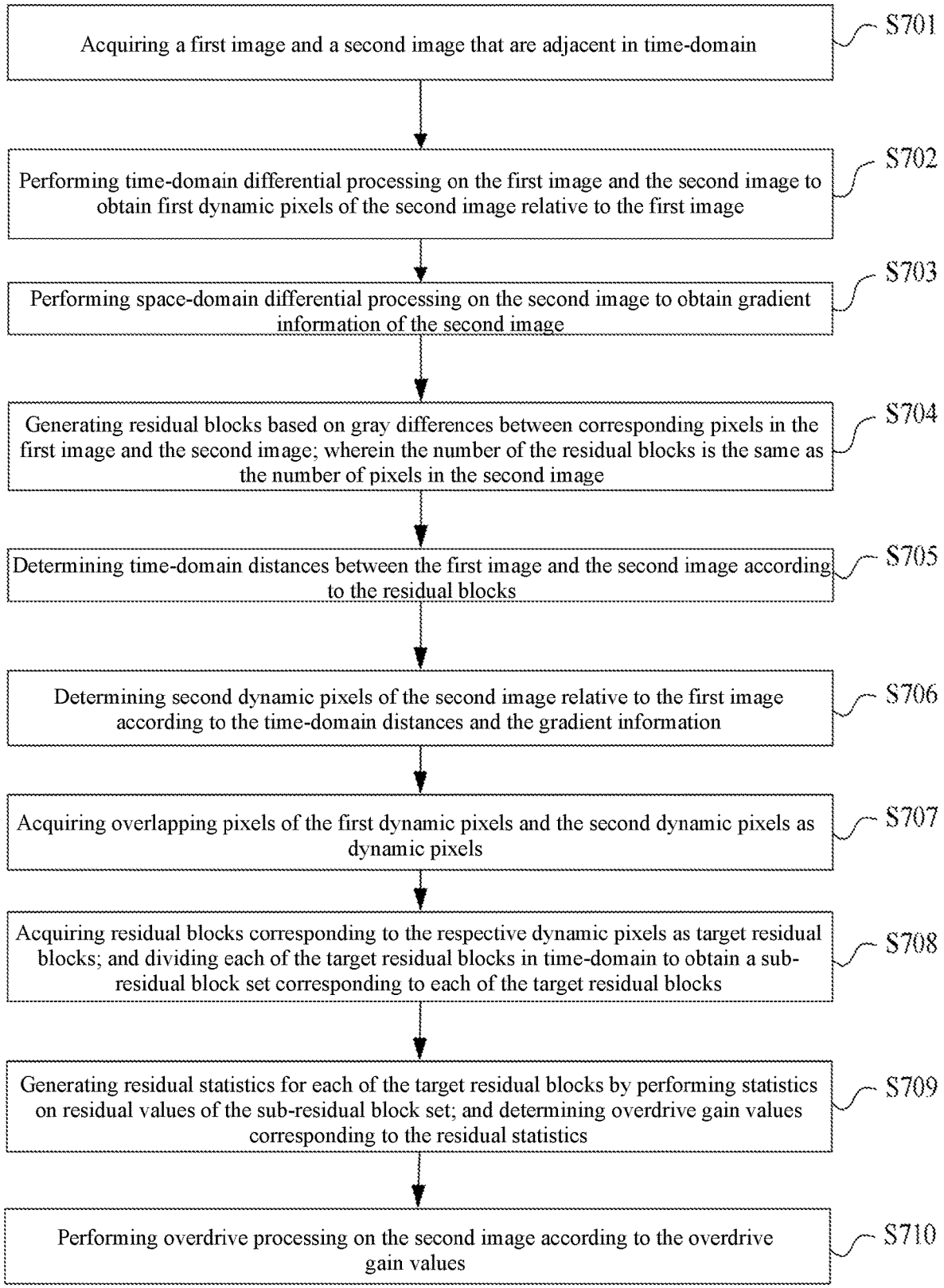
FIG. 7 is a schematic flowchart of an exemplary image processing method according to an embodiment of the present disclosure.

In order to better understand the image processing method, an example of the image processing method of the present disclosure will be described in detail below with reference to FIG. 7, comprising the following S701 to S710.

S701: Acquiring a first image and a second image that are adjacent in time-domain.

The first image and the second image may be two frame images that are adjacent in time-domain before being OD processed, and the timing of the first image may precede that of the second image. The numbers of pixels included in the first image and the second image are the same.

Specifically, the terminal or server used for image processing may acquire the first image and the second image from a preset database, and may also collect the first image and the second image in real time based on an image collect device, which is not limited in the embodiment.

S702: Performing time-domain differential processing on the first image and the second image to obtain first dynamic pixels of the second image relative to the first image.

Specifically, the terminal or server used for image processing may subtract pixel values of the first image and the second image pixel by pixel to obtain a difference of the pixel value of each of pixels, and then determine the first dynamic pixels based on absolute values of the above differences. The pixel value may include at least one of gray, brightness, saturation, and hue.

In the embodiment of the present disclosure, the terminal or server used for image processing may perform calculations on pixels based on pixel values of multiple channels, or may also perform calculations on pixels based on pixel values of a single channel, which is not specifically limited in the embodiment.

S703: Performing space-domain differential processing on the second image to obtain gradient information of the second image.

Specifically, the terminal or server used for image processing may perform space-domain transformation on the second image to obtain gradient values of each of the pixels in the second image in the horizontal and vertical directions, and obtain gradient information of the second image based on the gradient values.

S704: Generating residual blocks based on gray differences between corresponding pixels in the first image and the second image; wherein the number of the residual blocks is the same as the number of the pixels in the second image.

Specifically, the terminal or server used for image processing may calculate differences between gray values of the corresponding pixels in the first image and the second image to obtain absolute values of the gray differences corresponding to respective pixels, and then generate residual blocks with the same number as the pixels in the second image or the first image based on the absolute value of each of the gray differences.

S705: Determining time-domain distances between the first image and the second image according to the residual blocks.

Specifically, for each of the residual blocks, a sum of all residual values included in the residual block is calculated, and the sum is determined as the time-domain distance of the pixel corresponding to the residual block.

In the embodiment of the present disclosure, a residual blocks may be generated based on the unit size of n*m and the unit step $s_1$ according to the gray difference of each of the pixels, where the number of the pixels in the first image is also a. Then, the sum of the residual values (that is, the absolute values of the gray differences) in each of the residual blocks is calculated, and the sum of the absolute values of the gray differences in the residual block is determined as the time-domain distance M of the pixel corresponding to the residual block.

S706: Determining second dynamic pixels of the second image relative to the first image according to the time-domain distances and the gradient information.

Specifically, the terminal or server used for image processing may preset a compression error D introduced by image compression, and then comprehensively determine a dynamic or static state of each of the pixels according to the time-domain distance M, the gradient information G and the compression error D.

In the embodiment of the present disclosure, the determining may be made based on the following:

when M≥G+D, it is determined that the pixel is a second dynamic pixel; and when M≥G+D, it is determined that the pixel is a static pixel.

S707: Acquiring overlapping pixels of the first dynamic pixels and the second dynamic pixels as dynamic pixels.

In the embodiment of the present disclosure, the final dynamic pixels to be processed may be determined based on the results of the two dynamic detections. In the process of the dynamic detections, the calculation information of the time-domain and the space-domain is integrated, so the finally determined dynamic pixels are more accurate. Meanwhile, in the process of the dynamic detections, the compression error introduced by image compression is also comprehensively considered, so the compression error and the movement data of the pixels are effectively separated, which provides foundation for the accuracy of the subsequently overdrive processing on the image.

S708: Acquiring residual blocks corresponding to the respective dynamic pixels as target residual blocks; and dividing each of the target residual blocks in time-domain to obtain a sub-residual block set corresponding to each of the target residual blocks.

Specifically, the terminal or server used for image processing may divide each of the target residual blocks into k sub-residual blocks based on a unit size of h*j and a unit step s, and determine the above k sub-residual blocks as the sub-residual block set corresponding to the target residual block.

S709: Generating residual statistics for each of the target residual blocks by performing statistics on residual values of the sub-residual block set; and determining overdrive gain values corresponding to the residual statistics.

Specifically, the terminal or server used for image processing may generate residual statistics corresponding to the target residual block based on an extreme or mean value of the residual values in the sub-residual block set.

In some implementations, the target residual block may be divided in time-domain to obtain k sub-residual blocks, and for each of the sub-residual blocks, a sum of the residual values included in the sub-residual block is determined as a residual value $b_d$, where d is an integer not less than 1 and not greater than k. Then, the maximum of the residual values $b_d$ is determined as the residual statistics of the corresponding target residual block.

In other implementations, the target residual block may be divided in time-domain to obtain k sub-residual blocks, and for each of the sub-residual blocks, the sum of the residual values included in the sub-residual block is determined as the residual value $b_d$, where d is an integer not less than 1 and not greater than k. Then, the mean value of all residual values $b_d$ is calculated to obtain the residual statistics of the corresponding target residual block.

S710: Performing overdrive processing on the second image according to the overdrive gain values.

In the embodiment of the present disclosure, the terminal or server used for image processing may calculate difference between the pixel values of the image sequences based on the first image and the second image, and then obtain the OD voltage value according to the difference.

In some implementations, the terminal or server used for image processing may correct the OD voltage value based on the overdrive gain value, and then perform overdrive processing on the second image based on the corrected OD voltage value.

In other implementations, the terminal or server for image processing may first perform overdrive processing on the second image based on the OD voltage value, and then correct the second image which is overdrive processed according to the overdrive gain value.

In the embodiments of the present disclosure, the dynamic pixels are determined by performing dynamic and static detection on pixels of two frame images that are adjacent in time-domain, thus the dynamic and static regions in the image are separated. Then, overdrive processing is performed on the second image according to the overdrive gain values corresponding to the dynamic pixels. In view of the shortcoming that the error introduced by the compression algorithm and the pixel difference caused by the dynamic pixels may be mixed together in the overdrive process, the OD voltage of the overdrive is corrected for the dynamic pixels according to the overdrive gain values in the present disclosure. Thus, the overdrive effect for the dynamic region of the image is optimized, the technical effect of the overdrive is ensured, and the motion blur problem of the image display is effectively improved.

Figure 8:
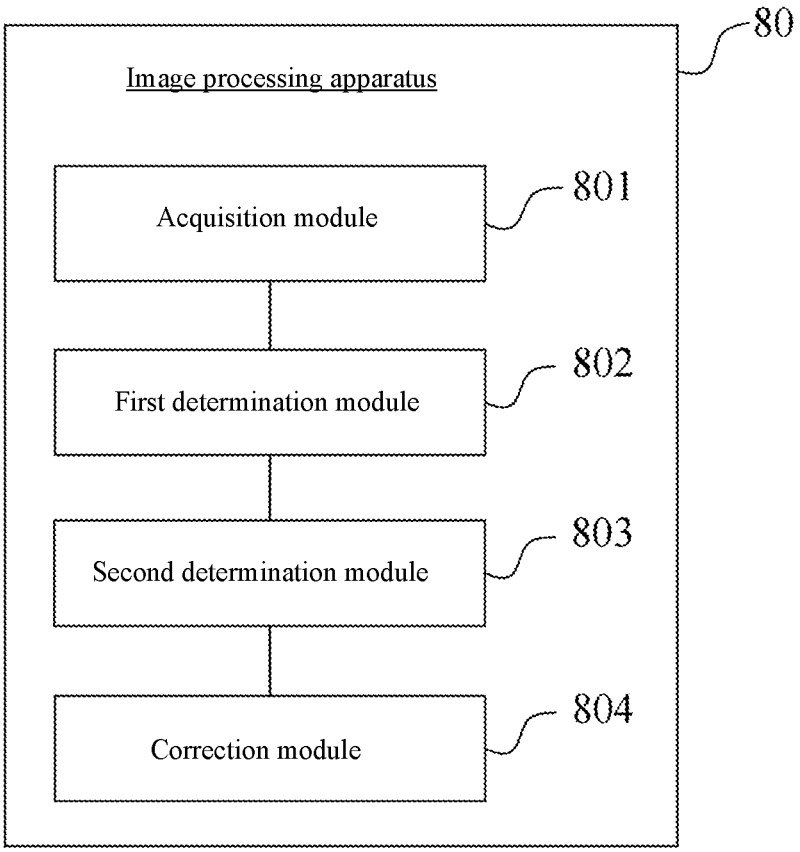
FIG. 8 is a schematic structure diagram of an image processing apparatus according to an embodiment of the present disclosure.

An embodiment of the present disclosure provides an image processing apparatus. As shown in FIG. 8, the image processing apparatus 80 may include an acquisition module 801, a first determination module 802, a second determination module 803, and a correction module 804;

wherein the acquisition module 801 is configured to acquire a first image and a second image that are adjacent in time-domain;

the first determination module 802 is configured to determine dynamic pixels of the second image relative to the first image;

the second determination module 803 is configured to determine overdrive gain values of the dynamic pixels; and the correction module 804 is configured to perform overdrive processing on the second image according to the overdrive gain values.

A possible implementation is provided in the embodiment of the present disclosure. The first determination module 802 is configured to:

perform time-domain differential processing on the first image and the second image to obtain first dynamic pixels of the second image relative to the first image;

perform space-domain differential processing on the second image to obtain gradient information of the second image;

acquire time-domain distances between the first image and the second image;

determine second dynamic pixels of the second image relative to the first image according to the time-domain distances and the gradient information; and acquire overlapping pixels of the first dynamic pixels and the second dynamic pixels as the dynamic pixels.

A possible implementation is provided in the embodiment of the present disclosure. The first determination module 802 is further configured to:

generate residual blocks based on the gray differences between corresponding pixels in the first image and the second image; wherein the number of the residual blocks is the same as the number of pixels in the second image; and determine the time-domain distances between the first image and the second image according to the residual blocks.

A possible implementation is provided in the embodiment of the present disclosure. The first determination module 802 is further configured to:

for each of the residual blocks, calculate a sum of all residual values included in the residual block, and determine the sum as the time-domain distance of the pixel corresponding to the residual block.

A possible implementation is provided in the embodiment of the present disclosure. The first determination module 802 is further configured to:

determine gray differences between corresponding pixels in the first image and the second image as the movement data of the pixels; and determine pixels corresponding to the movement data as first dynamic pixels, when the movement data is greater than a preset movement threshold.

A possible implementation is provided in the embodiment of the present disclosure. The second determination module 803 is configured to:

acquire residual blocks corresponding to the respective dynamic pixels as target residual blocks;

divide each of the target residual blocks in time-domain to obtain a sub-residual block set corresponding to each of the target residual blocks;

generate residual statistics for each of the target residual blocks by performing statistics on residual values of the sub-residual block set; and determine the overdrive gain value corresponding to the residual statistics.

A possible implementation is provided in the embodiment of the present disclosure. The second determination module 803 is further configured to:

for the sub-residual block set corresponding to the target residual block, determine the maximum of residual values of the sub-residual blocks as the residual statistics of the target residual block; and for the sub-residual block set corresponding to the target residual block, determine the mean value of the residual values of all sub-residual blocks as the residual statistics of the target residual block.

The apparatus of the embodiments of the present disclosure may perform the method of the embodiments of the present disclosure, and the implementation principles thereof are similar. The actions performed by modules in the apparatus of the embodiments of the present disclosure are the same as the steps in the method of the embodiments of the present disclosure. Correspondingly, for the detailed functional description of modules of the apparatus, reference may be made to the description in the corresponding method shown above, and details will not be repeated herein.

In the embodiments of the present disclosure, the dynamic pixels are determined by performing dynamic and static detection on pixels of two frame images that are adjacent in time-domain, thus the dynamic and static regions in the image are separated. Then, correction processing is performed on the second image according to the overdrive gain values corresponding to the dynamic pixels. In view of the shortcoming that the error introduced by the compression algorithm and the pixel difference caused by the dynamic pixels may be mixed together in the overdrive process, the OD voltage of the overdrive is corrected for the dynamic pixels according to the overdrive gain values in the present disclosure. Thus, the overdrive effect for the dynamic region of the image is optimized, the technical effect of the overdrive is ensured, and the motion blur problem of the image display is effectively improved.

The embodiment of the present disclosure provides an electronic device, including a memory, a processor, and a computer program stored in the memory. The processor executes the computer program to implement the image processing method. Compared with the related art, in the embodiments of the present disclosure, the dynamic pixels are determined by performing dynamic and static detection on pixels of two frame images that are adjacent in time-domain, thus the dynamic and static regions in the image are separated. Then, correction processing is performed on the second image according to the overdrive gain values corresponding to the dynamic pixels. In view of the shortcoming that the error introduced by the compression algorithm and the pixel difference caused by the dynamic pixels may be mixed together in the overdrive process, the OD voltage of the overdrive is corrected for the dynamic pixels according to the overdrive gain values in the present disclosure. Thus, the overdrive effect for the dynamic region of the image is optimized, the technical effect of the overdrive is ensured, and the motion blur problem of the image display is effectively improved.

Figure 9:
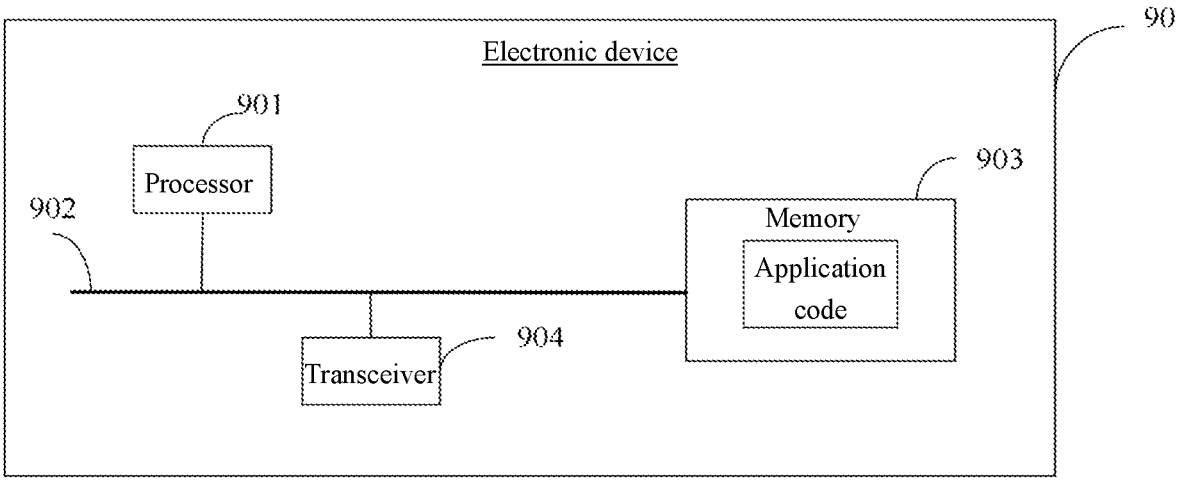
FIG. 9 is a schematic structure diagram of an image processing electronic device according to an embodiment of the present disclosure.

In an optional embodiment, an electronic device is provided. As shown in FIG. 9, the electronic device 900 shown in FIG. 9 includes a processor 901 and a memory 903. The processor 901 is connected to the memory 903, for example, through a bus 902. Optionally, the electronic device 900 may further include a transceiver 904, and the transceiver 904 may be used for data interaction between the electronic device and other electronic devices, for example, data transmission and/or data reception. It should be noted that, in practical applications, the number of the transceiver 904 is not limited to one, and the structure of the electronic device 900 does not constitute any limitations to the embodiments of the present disclosure.

The processor 901 may be a central processing unit (CPU), a general-purpose processor, a digital signal processor (DSP), an application specific integrated circuit (ASIC), or a field programmable gate array (FPGA), or other programmable logic devices, transistor logic devices, hardware components, or any combination thereof. It may implement or perform various exemplary logical blocks, modules and circuits described in connection with the present disclosure. The processor 901 may also be a combination for realizing computing functions, for example, a combination of one or more microprocessors, a combination of a DSP and a microprocessor, etc.

The bus 902 may include a path to transfer information between the components described above. The bus 902 may be a peripheral component interconnect (PCI) bus, or an extended industry standard architecture (EISA) bus, etc. The bus 902 may be an address bus, a data bus, a control bus, etc. For ease of illustration, the bus is represented by only one thick line in FIG. 9, however, it does not mean that there is only one bus or one type of buses.

The memory 903 may be, but is not limited to, read only memories (ROMs) or other types of static storage devices that may store static information and instructions, random access memories (RAMs) or other types of dynamic storage devices that may store information and instructions, may be electrically erasable programmable read only memories (EEPROMs), compact disc read only memories (CD-ROMs) or other optical disk storages, optical disc storages (including compact discs, laser discs, discs, digital versatile discs, blue-ray discs, etc.), magnetic storage media or other magnetic storage devices, or any other media that may carry or store computer programs and that can be accessed by computers.

The memory 903 is configured to store computer programs for performing the embodiments of the present disclosure, and is controlled by the processor 901. The processor 901 is configured to performing the computer programs stored in the memory 903 to implement the foregoing method as shown in the embodiments.

The electronic device includes, but is not limited to, a mobile terminal such as a mobile phone, a notebook computer, PAD, and a fixed terminal such as a digital TV and a desktop computer.

Embodiments of the present disclosure provide a computer-readable storage medium having computer programs stored thereon that, when executed by a processor, implement steps and corresponding contents of the foregoing method as shown in the embodiments.

Embodiments of the present disclosure provide a computer program product or computer program including computer instructions that are stored in a computer-readable storage medium. A processor of a computer device reads the computer instructions from the computer-readable storage medium, and the processor executes the computer instructions so that the computer device performs:

acquiring a first image and a second image that are adjacent in time-domain;

determining dynamic pixels of the second image relative to the first image;

determining overdrive gain values of the dynamic pixels; and performing overdrive processing on the second image according to the overdrive gain values.

Terms such as "first", "second", "third", "fourth", "1" and "2" (if any) as used in the description, claims and drawings of the present disclosure are used to distinguish similar objects, and are not necessarily used to define a specific order or sequence. It should be understood that data, as used in such way, may be used interchangeably if appropriate, so that the embodiments of the present disclosure described herein may be implemented in an order other than those illustrated or described herein.

It should be understood that although the steps are sequentially indicated by the arrows in the flowchart of the embodiments of the present disclosure, these steps are not necessarily performed in the order indicated by the arrows. Unless explicitly stated herein, in some implementation scenarios of the embodiments of the present disclosure, the steps in the flowcharts may be performed in other sequences as required. In addition, based on actual implementation scenarios, some or all of the steps in the flowcharts may include multiple sub-steps or multiple stages. Some or all of the sub-steps or stages may be performed at the same time, and each of the sub-steps or stages may be performed at different times. In scenarios in which each of the sub-steps or stages may be performed at different times, the order of performing these sub-steps or stages may be flexibly configured according to requirements, which is not limited in the embodiments of the present disclosure.

The foregoing descriptions are merely some optional implementations of the present disclosure. It should be noted that, for those ordinary skilled in the art, without departing from the technical concept of the solutions of the present disclosure, the use of other similar implementation means based on the technical concept of the present disclosure also belong to the protection scope of the embodiments of the present disclosure.

What is claimed is:

1. An image processing method, comprising:

acquiring a first image and a second image that are adjacent in time-domain;

determining dynamic pixels of the second image relative to the first image;

determining overdrive gain values of the dynamic pixels;

performing overdrive processing on the second image according to the overdrive gain values;

wherein the determining of the dynamic pixels of the second image relative to the first image comprises:

performing time-domain differential processing on the first image and the second image to obtain first dynamic pixels of the second image relative to the first image;

performing space-domain differential processing on the second image to obtain gradient information of the second image;

acquiring time-domain distances between the first image and the second image;

determining second dynamic pixels of the second image relative to the first image according to the time-domain distances and the gradient information; and acquiring overlapping pixels of the first dynamic pixels and the second dynamic pixels as the dynamic pixels; and wherein the acquiring of the time-domain distances between the first image and the second image comprises:

generating residual blocks based on gray differences between corresponding pixels in the first image and the second image;

wherein the number of the residual blocks is the same as the number of pixels in the second image; and determining the time-domain distances between the first image and the second image according to the residual blocks.

2. The method according to claim 1, wherein the determining of the time-domain distances between the first image and the second image according to the residual blocks comprises:

for each of the residual blocks, calculating a sum of all residual values included in the residual block, and determining the sum as the time-domain distance of a pixel corresponding to the residual block.

3. The method according to claim 1, wherein the performing time-domain differential processing on the first image and the second image to obtain the first dynamic pixels of the second image relative to the first image comprises:

determining gray differences between corresponding pixels in the first image and the second image as movement data of the pixels; and determining pixels corresponding to the movement data as the first dynamic pixels, when the movement data is greater than a preset movement threshold.

4. The method according to claim 1, wherein the determining of the overdrive gain values of the dynamic pixels comprises:

acquiring residual blocks corresponding to the respective dynamic pixels as target residual blocks;

dividing each of the target residual blocks in time-domain to obtain a sub-residual block set corresponding to each of the target residual blocks;

generating residual statistics for each of the target residual blocks by performing statistics on residual values of the sub-residual block set; and determining the overdrive gain value corresponding to the residual statistics.

5. The method according to claim 4, wherein the generating of the residual statistics for each of the target residual blocks by performing statistics on the residual values of the sub-residual block set comprise any one of:

for the sub-residual block set corresponding to the target residual block, determining a maximum of residual values of sub-residual blocks included in the sub-residual block set as the residual statistics of the target residual block; or for the sub-residual block set corresponding to the target residual block, determining a mean value of the residual values of all of the sub-residual blocks as the residual statistics of the target residual block.

6. An electronic device, comprising a memory, a processor and a computer program stored in the memory, wherein the processor executes the computer program to perform:

acquiring a first image and a second image that are adjacent in time-domain;

determining dynamic pixels of the second image relative to the first image;

determining overdrive gain values of the dynamic pixels;

performing overdrive processing on the second image according to the overdrive gain values;

wherein the determining of the dynamic pixels of the second image relative to the first image comprises:

performing time-domain differential processing on the first image and the second image to obtain first dynamic pixels of the second image relative to the first image;

performing space-domain differential processing on the second image to obtain gradient information of the second image;

acquiring time-domain distances between the first image and the second image;

determining second dynamic pixels of the second image relative to the first image according to the time-domain distances and the gradient information; and acquiring overlapping pixels of the first dynamic pixels and the second dynamic pixels as the dynamic pixels; and wherein the acquiring of the time-domain distances between the first image and the second image comprises:

generating residual blocks based on gray differences between corresponding pixels in the first image and the second image;

wherein the number of the residual blocks is the same as the number of pixels in the second image; and determining the time-domain distances between the first image and the second image according to the residual blocks.

7. The electronic device according to claim 6, wherein the determining of the dynamic pixels of the second image relative to the first image comprises:

performing time-domain differential processing on the first image and the second image to obtain first dynamic pixels of the second image relative to the first image;

performing space-domain differential processing on the second image to obtain gradient information of the second image;

acquiring time-domain distances between the first image and the second image;

determining second dynamic pixels of the second image relative to the first image according to the time-domain distances and the gradient information; and acquiring overlapping pixels of the first dynamic pixels and the second dynamic pixels as the dynamic pixels.

8. A non-transitory computer-readable storage medium storing a computer program stored thereon that, when executed by a processor, configured to cause the processor to perform:

acquiring a first image and a second image that are adjacent in time-domain;

determining dynamic pixels of the second image relative to the first image;

determining overdrive gain values of the dynamic pixels;

performing overdrive processing on the second image according to the overdrive gain values;

wherein the determining of the dynamic pixels of the second image relative to the first image comprises:

performing time-domain differential processing on the first image and the second image to obtain first dynamic pixels of the second image relative to the first image;

performing space-domain differential processing on the second image to obtain gradient information of the second image;

acquiring time-domain distances between the first image and the second image;

determining second dynamic pixels of the second image relative to the first image according to the time-domain distances and the gradient information; and acquiring overlapping pixels of the first dynamic pixels and the second dynamic pixels as the dynamic pixels; and wherein the acquiring of the time-domain distances between the first image and the second image comprises:

generating residual blocks based on gray differences between corresponding pixels in the first image and the second image;

wherein the number of the residual blocks is the same as the number of pixels in the second image; and determining the time-domain distances between the first image and the second image according to the residual blocks.

9. The non-transitory computer-readable storage medium according to claim 8, wherein the determining of the dynamic pixels of the second image relative to the first image comprises:

performing time-domain differential processing on the first image and the second image to obtain first dynamic pixels of the second image relative to the first image;

performing space-domain differential processing on the second image to obtain gradient information of the second image;

acquiring time-domain distances between the first image and the second image;

determining second dynamic pixels of the second image relative to the first image according to the time-domain distances and the gradient information; and acquiring overlapping pixels of the first dynamic pixels and the second dynamic pixels as the dynamic pixels.

* * * * *